United States Patent [19]

Yoshida et al.

[11] Patent Number: 4,578,872

[45] Date of Patent: Apr. 1, 1986

[54] SCALE BALANCING DEVICE IN UNIVERSAL PARALLEL RULER DEVICE

[76] Inventors: Yasutomo Yoshida; Hideo Mikuriya, both of c/o Mutoh Industry Ltd., Setagaya-ku, Tokyo, Japan

[21] Appl. No.: 689,900

[22] Filed: Jan. 9, 1985

[51] Int. Cl.[4] ..... B43L 13/08

[52] U.S. Cl. ..... 33/438; 33/440

[58] Field of Search ..... 33/438, 430, 439, 440, 33/448

[56] References Cited

U.S. PATENT DOCUMENTS 4,070,758 1/1978 Watanabe ..... 33/438

4,268,969 5/1981 Koenuma ..... 33/438

*Primary Examiner*—Willis Little

*Attorney, Agent, or Firm*—Wenderoth, Lind & Ponack

[57] ABSTRACT

A scale balancing device for balancing the weight of the scales of a universal parallel ruler, the device having a head structure having a rotating scale support rotatably mounted thereon on which the scales are carried, a rotating member rotatably mounted on the head structure offset from the rotating support, the rotating member and the scale support being rotatably interlocked, an eccentric member movably mounted on the rotating member for movement radially of the rotating member, and a spring member having one end connected to the eccentric member and the other end connected to the head structure and tensioned for providing a torque on the rotating member in a direction which substantially cancels out the torque on the rotating member from the weight of the scales.

3 Claims, 13 Drawing Figures

SCALE BALANCING DEVICE IN UNIVERSAL PARALLEL RULER DEVICE

BRIEF SUMMARY OF THE INVENTION

This invention relates to a scale balancing device in universal parallel ruler device wherein a scale is caused to be set in a freely rotatable condition relative to a non-rotating member of a head on an inclinable drawing board whereby the scale is not rapidly rotated in a downward direction due to an inclination of the drawing board to maintain the scale in a stable and static condition.

Scale balancing devices in a universal parallel ruler device are available in various types, but the devices are classified roughly into a balance weight system and an eccentric cam system. The balance weight system is one in which the weight of a balance weight is caused to work in a direction opposite to the rotating direction on a member interlocked with the rotation of a scale in a downward direction to balance the scale by the action of the weight. A balancing device of this type is disclosed in the publications, for example, the Japanese Utility Model Publication No. 47-9478, Japanese Patent Publication No. 57-47040, Japanese Patent Publication No. 57-49399 and Japanese Patent Publication No. 58-4640. On the other hand, the eccentric cam system is one in which a spring is caused to work on an eccentric cam interlocked with the rotation of a scale, and a rotatory torque is generated on the eccentric cam by the elastic force of the spring in a direction opposite to the rotating direction of the scale due to the weight of the scale to balance the scale. A balancing device of the eccentric cam system type is disclosed in the Japanese Utility Model Publication No. 52-28605.

The universal parallel ruler device is normally mounted on an inclinable drawing board. Accordingly, when the inclination of the drawing board is almost perpendicular, the downward force due to the weight of the scale is increased, and on the contrary, in a condition where an the angle of the drawing board is moderate, the downward force of the scale is decreased. In the foregoing weight system, since the balancing force of the weight is changed according to the change of the downward force of the scale, there is no need of adjusting the balancing force for each change of inclination of the drawing board. However, because a weight is mounted on a member interlocked with the scale, the weight of the entire balancing device is increased, and the rotation by manual operation becomes hard due to inertia force of the balance weight which is a drawback. In the foregoing eccentric cam system, when the adjustment of the balance force is to be made, the spring force of an elastic member acting on the eccentric cam must be changed. In this case, when the spring is expanded for the purpose of increasing the balance force and the amount of bending of the spring is increased, there is a drawback that the spring becomes fatigued.

A primary object of this invention is to provide a scale balancing device without a balance weight or an eccentric cam in which one end of spring means having non-rotating member of a head as a fulcrum is connected to an eccentric portion of a rotating member that rotates with the scale, whereby the scale can be easily rotated by hand.

Another object of this invention is to provide a scale balancing device that permits an adjustment of the balance force without a change of a large amount of bending of the spring means and also permits use of a spring means which always has the proper amount of bending.

DESCRIPTION OF THE PREFERRED EMBODIMENT

A construction of this invention will be described in detail by referring to an embodiment illustrated in the attached drawings.

Figure 1:
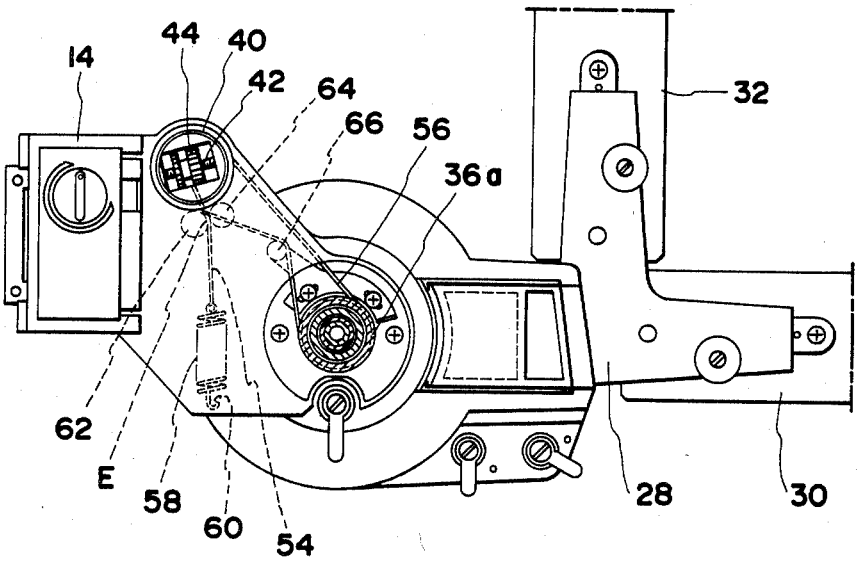
FIG. 1 is a plan view partly in cross section of one embodiment of the invention.
Figure 2:
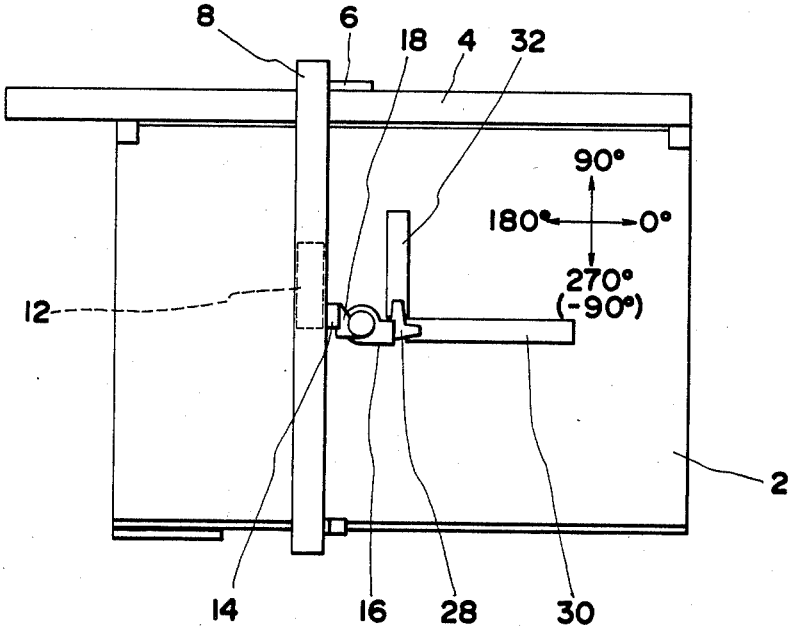
FIG. 2 is an elevation view of a universal parallel ruler device.
Figure 3:
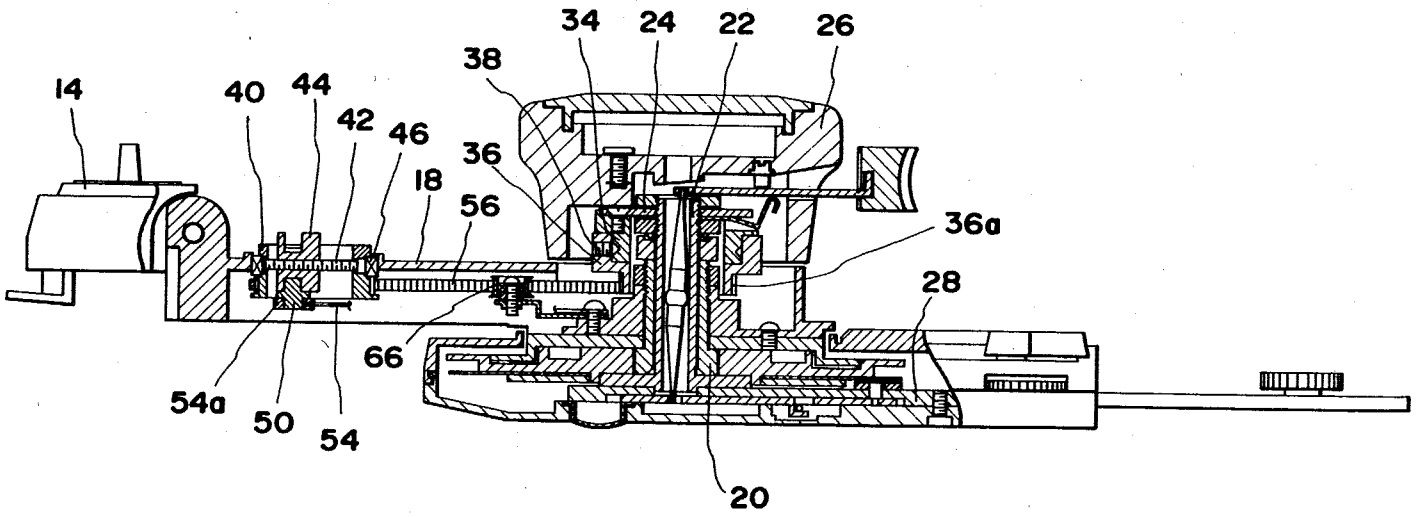
FIG. 3 is a cross section of a head in which the scale balancing device of the invention is incorporated.
Figure 4:
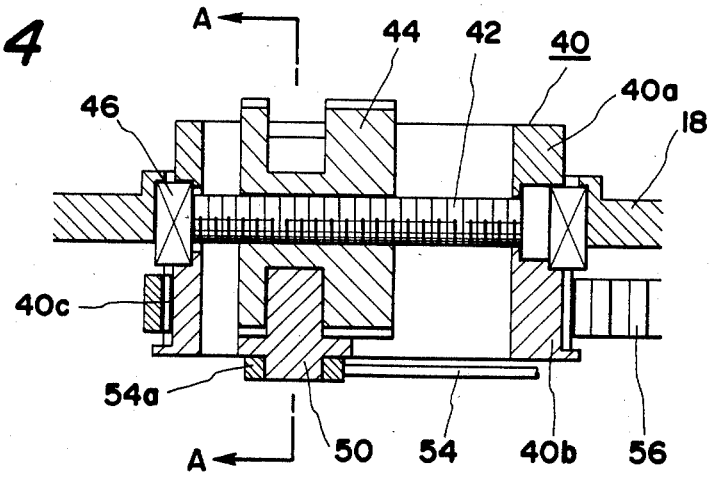
FIG. 4 is a cross section of a balance force adjusting device used in the head of FIG. 3.
Figure 5:
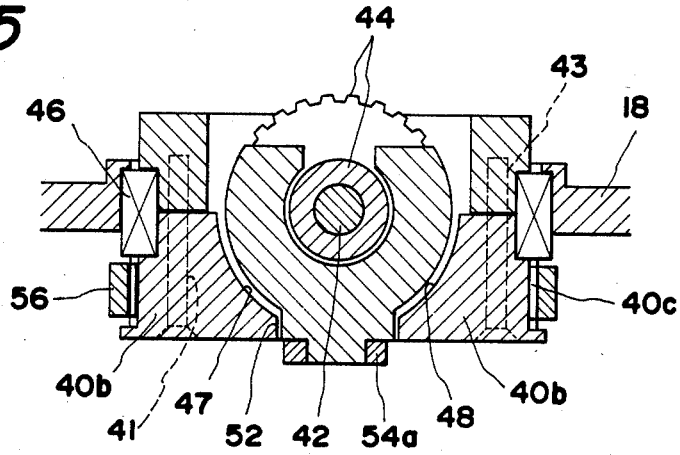
FIG. 5 is a cross section taken on line A—A in FIG. 4.
Figure 6:
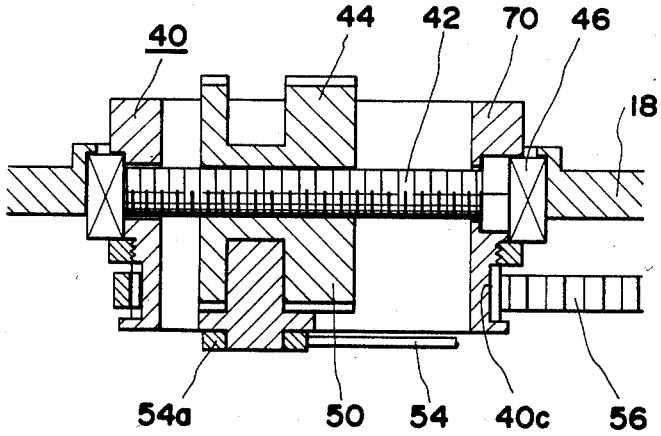
FIG. 6 is a cross section illustrating another embodiment of a balance force adjusting device.

In FIG. 2, numeral 2 denotes a drawing board, which is supported on a support frame of a drawing stand capable of tilting so as to be set at a desired angle between the horizontal and the vertical. Numeral 4 denotes a horizontal rail fixed to the upper edge of the drawing board 2, and a horizontal cursor 6 is shiftably mounted on the horizontal rail 4. The upper end of a vertical rail 8 is connected to the horizontal cursor 6. The lower end of the vertical rail 8 is mounted shiftably on the drawing board 2 by means of a tail portion roller. Numeral 12 denotes a vertical cursor mounted shiftably on the vertical rail 8, and a support base plate 18, namely, a non-rotating member is connected to the vertical cursor 12 by means of a known double hinge mechanism 14. As shown in FIG. 3, a tubular member 20 is fixed to a tubular portion of the support base plate 18 by means of a nut. Numeral 22 denotes a tubular spindle, and the outer peripheral surface of the spindle is rotatably inserted in the tubular member 20 in engagement with the inner peripheral surface thereof, and a mounting plate 24 is fixed to the upper portion of the spindle 22. A handle 26 is fixed to the mounting plate 24. Numeral 28 denotes a scale mounting plate fixed to a flange portion of the spindle 22, and scales 30 and 32 are fixed to the scale mounting plate. Numeral 34 denotes a cylinder fixed to the scale mounting plate 24, and a first tubular rotating member 36 is rotatably fitted an outer peripheral surface of the cylinder 34. A belt pulley **36*a* having teeth for engagement with a timing belt 56 is fixed to a lower portion of the rotating member 36. A tapped hole is formed in a side wall of the rotating member 36, and the rotating member 36 is fixed to the tubular member 34 by a stationary screw 38 screwed into the tapped hole. Numeral 40 denotes a second rotating member, which is composed of an upper cylinder 40***a* and a lower cylinder 40*b*, and the cylinders 40*a* and 40*b* are connected by screws 41 and 43 (refer to FIG. 5). In the middle of the rotating member 40, a feed screw 42 is mounted in a diametral direction of the rotating member 40, and an adjusting knob 44 is threaded onto the screw 42. An inner ring of a ball bearing 46 is fitted and fixed in a concave groove formed on the outer peripheral portion of the rotating member 40, and the outer ring of the ball bearing 46 is fitted and supported on an inner wall surface of the hole bored in the support base plate 18. A pair of curved guide surfaces 47 and 48 are formed on the cylinder 40*b*, and the outer peripheral curved surface of an element 50 fitted rotatably in a concave portion of the knob 44 is opposed to an disposed in the guide surfaces 47 and 48. The guide surfaces 47 and 48 prevent the falling of the element 50 due to its weight. A long hole is bored in a bottom wall of the cylinder 40*b* along the feed screw 42, and a projection of the element 50 is shiftably mounted in the long hole 52. A metal terminal 54*a* connected to one end of a bendable wire rope 54 having flexibility is rotatably fitted on the projection of the element 50. A belt pulley 40*c* formed with teeth for the timing belt is formed on an outer periphery of the rotating member 40, and the timing belt 56 is reeved around the belt pulley 40*c* and the belt pulley 36*a*. Numeral 58 denotes a coil spring, and its one end is engaged with a screw 60 on the support base plate 18, and the other end is connected to the rope 54. Numeral 62 and 64 denote a pair of rope guides rotatably journaled on the support base plate 18, and numeral 66 denotes a tension pulley for belt 66, and which is rotatably journaled on a bracket fixed to the support base plate 18. Assuming that one end of the metal terminal 54*a*, namely, the rope 54 is released from the element 50, and is positioned at a direction control end E of the rope by the rope guides 62 and 64, an initial position of the coil spring 58 is set so that the tension of the rope 54 caused by the coil spring 58 is zero. The coil spring 58 is a type which has a spring constant corresponding to the torque generating force on the first rotating member 36 by the weight of the scale mounting plate 28, and scales 30 and 32. The belt pulley 36*a* may be fixed to the scale mounting plate 28. The coil spring 58 and the rope 54 constitute elastic means for providing a torque generating force for balance of the rotating member 40. The elastic means is not particularly limited to the construction illustrated in the drawing. The head 16 is constructed in such a way that it can be stationary at an optional position on the inclined drawing board 2 by a known head balancing device (not shown).

The operation of this embodiment of this invention will be described in the following.

Figure 7:
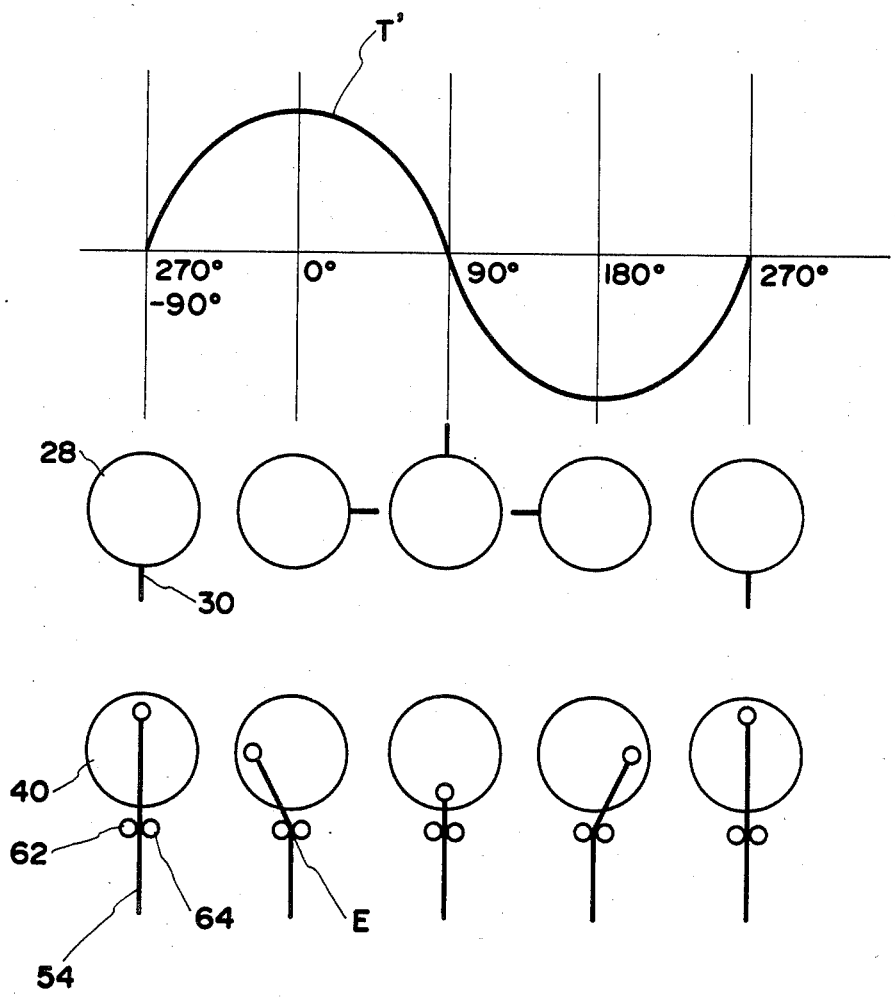
FIG. 7 is an explanatory diagram for the scale balancing device of the invention.

In a condition where the drawing board 2 is at the tilt at a predetermined angle and the scale mounting plate 28 is in a freely rotatable condition relative to the support base plate 18, a torque T centering around the spindle 22 is generated on the first rotating member 36 by the weight of the scale mounting plate 28, scales 30 and 32. The magnitudes of the torque T and a torque T′ acting on the second rotating member 40 from the elastic force of the coil spring 58 are set at an identical value, and also the torques are in opposite directions. Accordingly, the scale mounting plate 28 does not rapidly rotate relative to the support base plate 18 on the inclined drawing board 2. The scale mounting plate 28 can be rotated 360 degrees by turning the handle 26. Accordingly, the scales 30 and 32 can be set at a desired angle relative to the support base plate 18 of the head, and the scales 30 and 32 remain in a stable static condition against the support base plate 18 of the head on the inclined drawing board 2 even if the hand of the operator is released from the handle 26. When the manual rotation of the scales 30 and 32 is carried out and the second rotating member 40 is rotated, the torque T′ of the rotating member 40 from the coil spring 58 is changed like a sine curve as shown in FIG. 7. Even if the second rotating member 40 is rotated more than 360 degrees, the rope 54 is not hooked on the rotating member 40 so that the scale mounting plate 28 can be rotated any number of times.

The operation of adjusting the magnitude of the rotatory torque T′ will be described in the following.

When the knob 44 is rotated, the knob 44 is shifted along the feed screw 42, and the element 50 is shifted along the feed screw 42. One end 54*a* of the rope 54 is shifted in a radial direction relative to the second rotating member 40 by the shifting of the element 50. The distance between the center of the rotating member 40 and the spring operating point, namely the radius of the torque generating element is changed by the shifting of the one end 54*a* of the rope 54 relative to the rotating member 40, and the torque T′ of the rotating member 40 is changed. A value of the load W applied at the position of center of gravity of the scale mounting plate 28 is changed according to a change of the inclination of the drawing board 2 by the weight of the scales 30 and 32. When the drawing board 2 is set perpendicularly, the load W becomes a maximum, and when the drawing board 2 is set horizontally, the load W becomes zero. Accordingly, when the inclination of the drawing board 2 is changed, the magnitude of the torque T′ generated on the second rotating member 40 by the tensile load of the coil spring 58 can be made the same or that of the torque T generated on the first rotating member 36 by the load W by adjusting the position of the knob 44.

Another embodiment of this invention will be described in the following with reference to FIG. 8 through FIG. 11.

Figure 8:
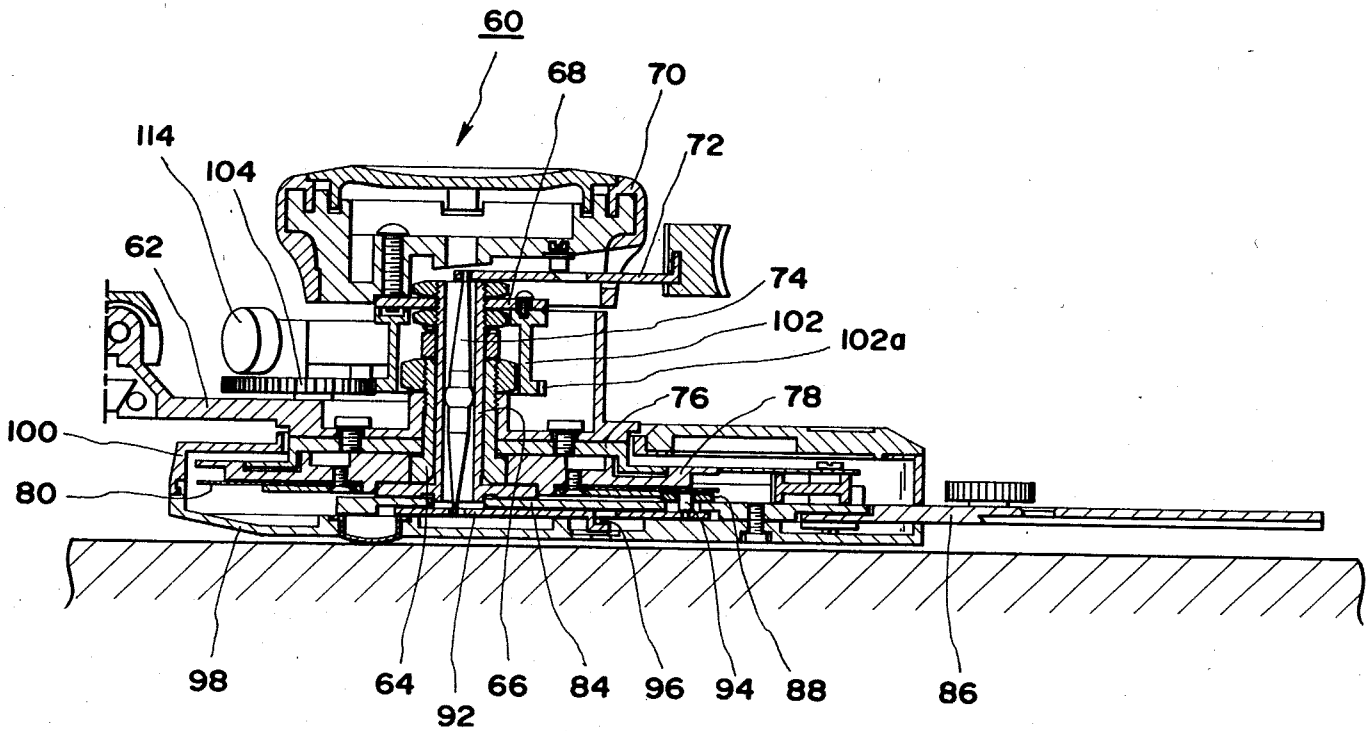
FIG. 8 is a cross section illustrating another embodiment of a head.
Figure 9:
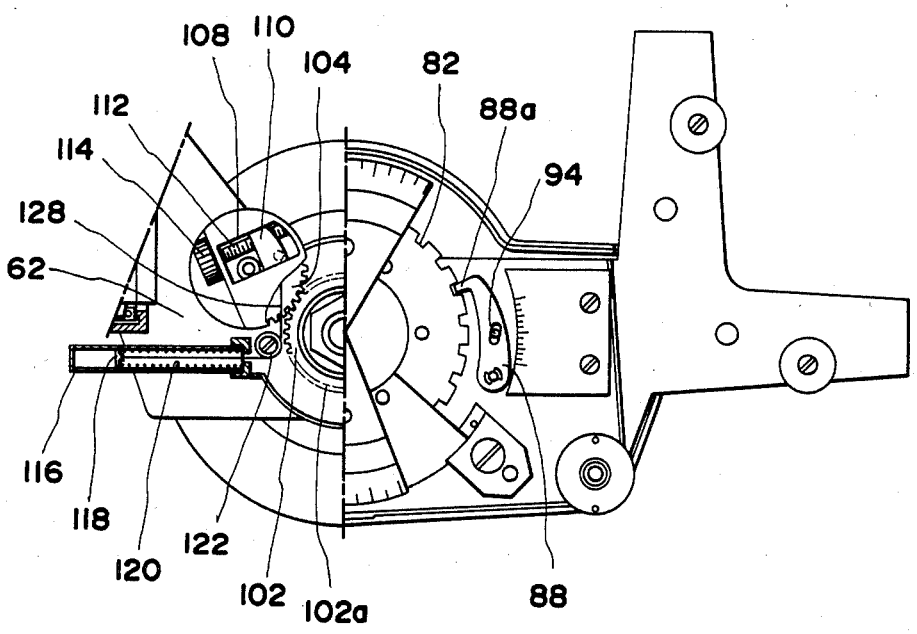
FIG. 9 is a plan view partially cut away illustrating another embodiment of the head.
Figure 10:
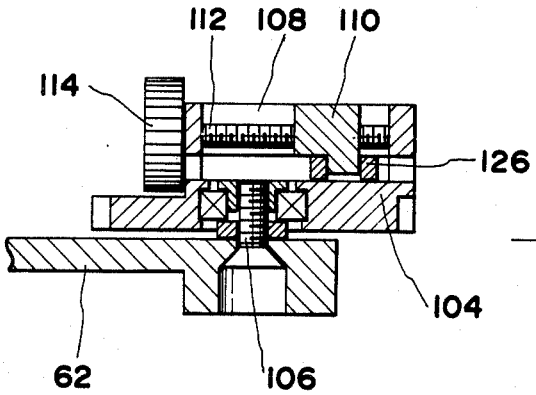
FIG. 10 is a cross section taken on line 9—9 in FIG. 8.
Figure 11:
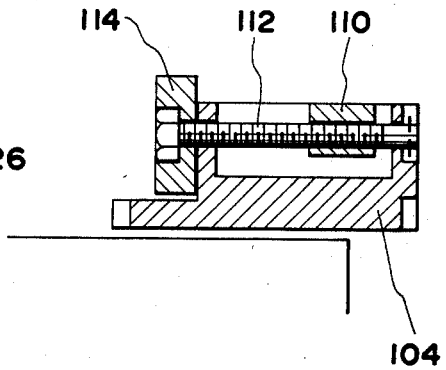
FIG. 11 is a cross section taken on line 10—10 in FIG. 8.

In FIG. 8, numeral 60 denotes a head and a support base plate 62 of the head 60 is connected to the vertical cursor 12 (refer to FIG. 2) by means of a known double hinge mechanism. A tubular member 64 is fixed to a tubular portion of the support base plate 62 by means of a nut. Numeral 66 denotes a spindle tube, and its outer peripheral surface is inserted rotatably into the inner peripheral surface of the tubular member 64 and a mounting plate 68 is fixed to an upper portion of the spindle tube 66. A grip handle 70 is fixed to the mounting plate 68. Numeral 72 denotes an index lever, and one end portion of the index lever 72 is connected to an upper end of a conical bar 74 disposed in the interior of the spindle tube 66. Numeral 76 denotes a stationary disc fixed to the support base plate 62, and 78 denotes a protractor rotatably fitted to an outer peripheral surface of the flange portion of the tubular member 64, and the protractor 78 is fixed to the stationary disc 76 by means of a stationary mechanism (not shown) which is capable of being replaced. Numeral 80 denotes an index ring fixed to the protractor 78, and index concave portions 82 are formed on its outer peripheral portion at predetermined intervals (refer to FIG. 9). Numeral 84 denotes a base plate fixed to the flange portion of the spindle tube 66, and a scale mounting plate 86 is mounted on the base plate 84. Numeral 88 denotes a swing arm whose one end portion is rotatably and pivotally supported on the base plate 84 by a shaft 90, and a pawl portion 88*a* of the swing arm 88 is fittable into the index concave portions 82. One end of a transmitting member 92 is connected to a lower end of the conical bar 74, and a shaft 94 fixed to the other end of the transmitting member 92 is fitted to a long groove formed on the swing arm 88. The transmitting member 92 is energized in a vertical direction by a spring member 96. The index lever 72, conical bar 74, index ring 80, swing arm 88, and transmitting member 92 constitute means for fixing the base plate 84 to the protractor 78 and releasing the fixed base plate 84. A scale is detachably fixed to the scale mounting plate 86. Numeral 98 denotes a bottom portion cover fixed to the base plate 84, and 100 denotes an upper portion cover mounted on the cover 98. The support base plate 62, stationary disc 76, protractor 78, index ring 80 and tubular member 64 constitute a non-rotating member of the head. Numeral 102 denotes a tubular member fixed to the mounting plate 68, and teeth 102*a* are formed on a lower portion of the tubular member 102. The center of rotation of the teeth 102*a* and the center of rotation of the spindle tube 66 are concentric. Numeral 104 denotes a gear rotatably journaled at 106 to the support base plate 62, and the gear 104 is meshed with the teeth 102*a*. Numeral 108 denotes a guide groove formed on a projection of the gear 104 in a direction parallel to the radius of the gear 104, and an element 110 is slidably disposed in the guide groove in the longitudinal direction of the guide groove 108. Numeral 112 denotes a threaded shaft rotatably supported on the gear proper 104 extending through a threaded hole of the element 110. A knob 114 is fixed to one end of the shaft 112. Numeral 116 denotes a cylinder whose one end open portion is fixed to the support base plate 62, and a disc member 118 is slidably disposed in the inside. Numeral 120 denotes a coil spring disposed in the cylinder 116, and its one end is elastically in contact with the disc member 118. Numeral 122 denotes a rope guide composed of a rope pulley rotatably journaled on the support base plate 62, and a bendable wire rope 124 having a flexibility is reeved around the rope guide 122. One end of the rope 124 is connected to the disc member 118. The other end of the rope 124 has a metal terminal 126, and the terminal 126 is connected to a projection of the element 110. When the terminal 126 is positioned at a control end of the rope, an initial zero position of the spring 120 is set so that the tension on the rope 124 from the spring 120 becomes zero, and also, a spring 120 is employed which has a spring constant corresponding to the weight of the base plate 84, scale mounting plate 86 and scale.

The cylinder 116, disc member 118, coil spring 120 and rope 124 are connected to an eccentric position of the gear 104, namely, the rotating member 104, and elastic means is connected to the rotating means 104 which provides a rotary force in a direction opposite to the direction due to the weight of the scale of the rotating member 104.

Also, the guide groove 108, element 110, shaft 112, and knob 114 constitute a mechanism for shifting the point of connection of the elastic means relative the rotating member 104 in a radial direction of the rotating member 104.

The operation of the embodiment of this invention will be described in the following.

In the first place, the drawing board 2 is set at a desired angle relative to the floor. Next, with the bed 60 is static at an optional position on the drawing board 2, the index lever 72 is shifted in a left direction in FIG. 8 by manual operation, the conical bar 74 is swung in a counterclockwise rotating direction with the bulged portion 74*a* of the conical bar as a fulcrum, and the transmitting member 92 is shifted in a right direction. By this movement, the swing arm 92 is swung in a clockwise rotating direction in FIG. 8 centering around the shaft 90, and its pawl portion 88*a* is separated from the concave portion 82 of the index ring 80, and the scale mounting plate 86 becomes free to rotate centering around the tubular member 64. Namely, the fixing of the scale mounting plate 86 to the non-rotating member is released. In this condition, an operator rotates the knob 114 and rotates the threaded shaft 112, and shifts the element 110 along the guide 108, namely in a radial direction of the rotating member 104, and changes the eccentric position of one end of the rope 124 relative to the rotating member 104. The operator stops the rotation of the knob 114 when the scale mounting plate 86 is in balance, which completes the adjusting operation. In this condition, a torque 7 is generated which centers around the spindle 66 by the weight of the base plate 84, scale mounting plate 86 and scale. The magnitude of the torque 7 and that of the torque 7' working on the rotating member 104 by the elastic force of the spring 120 are identical, and the torques are opposite in direction. Accordingly, the scale is static on the drawing board 2 in its free rotating condition, and does not rotate rapidly due to its own weight. When the operator grips the handle 70 of the head 60 and applies pressure in the optional direction in parallel to the surface of the drawing board 2, he can parallelly shifts the head 60 to a desired location on the drawing board 2. When the angle of the drawing board 2 is changed to another angle, the operator rotates the knob 114 in the foregoing manner and adjusts the eccentric position of the operation point of the elastic means on the rotating member 104 and adjusts the maximum value of the torque of the rotating member 104 so that the scale is just balanced.

Figure 12:
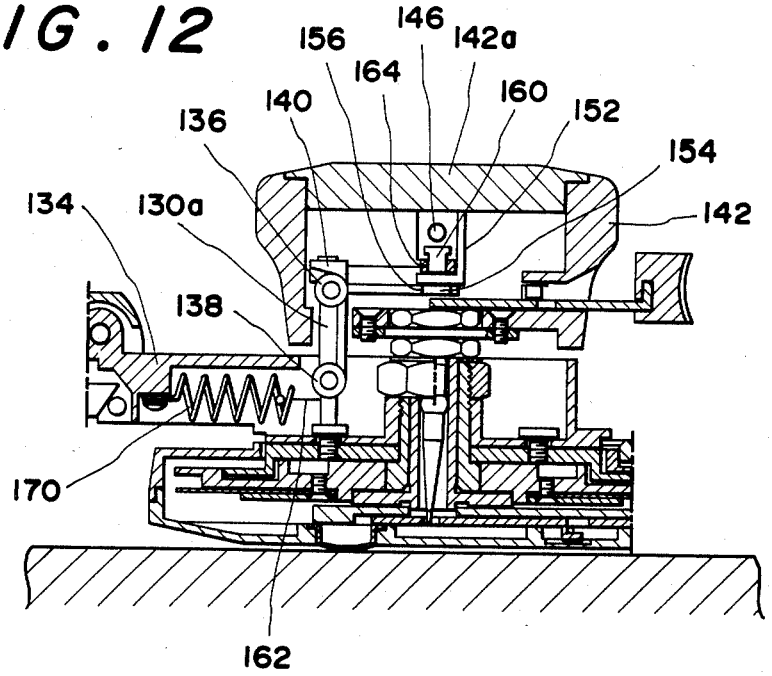
FIG. 12 is a cross section illustrating another embodiment of the head.
Figure 13:
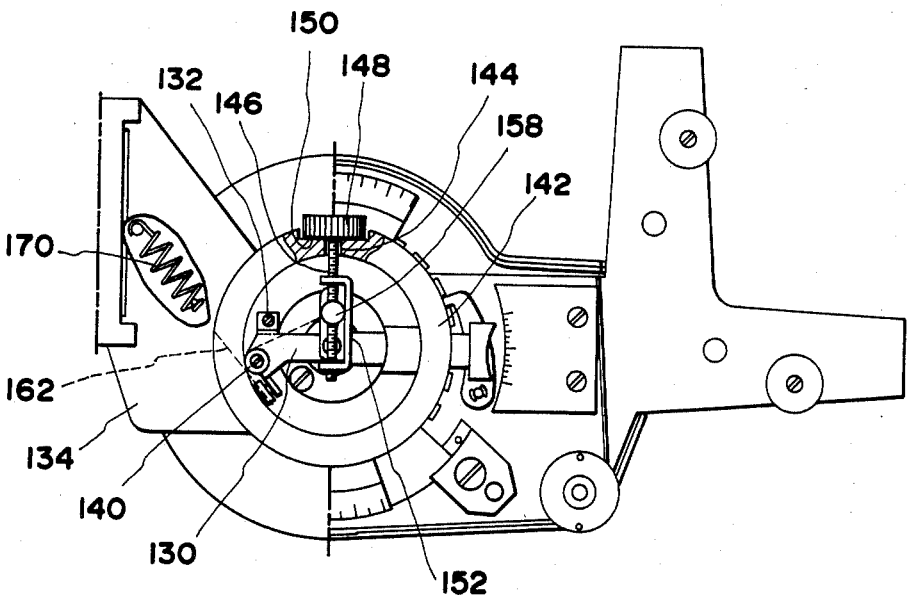
FIG. 13 is a plan partially cut away illustrating another embodiment of the head.

Another embodiment of this invention will be described in the following with reference to FIG. 12 and FIG. 13.

Numeral 130 denotes a bracket, and a lower end of a perpendicular portion 130*a* of the bracket is fixed to a support base plate 134 by a screw 132. On upper and lower ends of the perpendicular portion 130*a* of the bracket 130, vertical rope pulleys 136 and 138 are rotatably journaled. The upper end of the perpendicular portion 130*a* is adjacent to the rope pulley 136 and a rope guide 140 composed of a horizontal rope pulley is rotatably journaled thereon. Numeral 146 denotes a threaded lever rotatably inserted into a horizontal hole 144 bored on a side wall of a handle 142 (rotating member), and a knob 148 is fixed to its one end. A recess 150 formed on the handle 142 rotatably abuts on one surface of the knob 148. Numeral 152 denotes a frame, and the threaded lever 146 is rotatably inserted into holer bored in a pair of side walls of the frame 152, and a disc like projection 154 projecting from the bottom wall of the frame 152 is rotatably fitted to a hole 156 bored in a horizontal portion of the bracket 130. The center of the hole 156 coincided with the center of rotation of the handle 142. The upper end of the frame 152 abuts on a lower surface of a cap 142*a* of the handle 142. Numeral 158 denotes an element threaded on the shaft 146, and a shaft 160 is fixed to the lower end of the element 158, and a terminal 164 of a wire rope 162 is fitted on the shaft 160. The shaft 146 is constructed so that it is not shifted in the axial direction of the shaft 146 relative to the frame 152 by a stop ring. The lower end of the shaft 160 abuts slidably on an upper surface of the horizontal portion of the frame 164, and one side surface and the upper surface of the element 158 abut slidably on the side surface of the perpendicular portion of the frame 152 and the lower surface of the cap 142*a* of the handle 142. Numeral 170 denotes a coil spring whose one end portion is connected to the support base plate 134, and one end of the wire rope 162 having a flexibility is connected to the other end portion of the coil spring 170. The wire rope 162 is reeved around the pulleys 136 and 138 and the rope guide 140, and the other end is connected to the terminal 164. The internal construction of the head is identical with the construction of the head illustrated in FIG. 8 so that the description of thereof is omitted. In the foregoing construction, if center of the hole of the terminal 164 is shifted to the control end E of the rope, the setting is made so that the tensile force of the spring 170 becomes zero. When the handle 142 of the head is rotated in a counterclockwise rotating direction in FIG. 12 until the horizontal scale 30 becomes almost parallel to the vertical rail 8 (refer to FIG. 2), and the rotatory torque 7 generated on the handle 142 by the weight of the scales 30 and 32 is zero, the terminal 164 approaches most closely to the rope guide 136, and the setting is made so that a radius R of the position of the rotatory torque generating element of the handle 142 by the spring 170 becomes zero. The rotatory torque 7 generated in a clockwise rotating direction in FIG. 13 on the base plate 84 by the weight of the scale and the scale mounting plate is transmitted to the handle 142 (rotating member) by means of the spindle tube 66. On the other hand, the tensile force of the spring 170 is transmitted to the handle 142 by means of the rope 162 and the element 158, and the rotatory torque 7′ is generated on the handle 142 in a counterclockwise rotating direction in FIG. 12 by the tensile force of the spring 170. In a condition where the drawing board is fixed at a predetermined angle, the magnitudes of the rotary torques T and T′ are set to be equal, and when the scale is in a free condition, the scale will remain in a static condition on the drawing board, and keeps a complete balance. When the angle of the drawing board is changed, the magnitude of the torque 7 is changed. In this case, the knob 148 is rotated and the element 158 is shifted in a radial direction of the handle 142 along the lever 146 and the magnitude of the rotary torque T′ is made to coincide with the magnitude of the torque T.

The spring 170 and the rope 162 are connected to an eccentric position on the rotating member 142 , and the elastic means is constructed to provide a rotary force on the rotating member 142 in a direction opposite to the rotating direction due to the weight of the scale on the rotating member 142. Also, the horizontal hole 144 in the handle 142, screw 146, knob 148, frame 152 and the element 158 constitute a mechanism for shifting the point of operation of the elastic means on the rotating member 142 in a radial direction of the rotating member 142.

What is claimed is:

1. A scale balancing device for balancing the weight of the scales of a universal parallel ruler, said device comprising a head structure having a rotating scale support rotatably mounted thereon on which said scales are carried, a rotating member rotatably mounted on said head structure separate from said rotating support, means rotatably interlocking said rotating member and said scale support, an eccentric member movably mounted on said rotating member for movement radially thereof, and a spring member having one end connected to said eccentric member and the other end connected to said head structure and tensioned for providing a torque on said rotating member in a direction which substantially cancels out the torque on said rotating member from the weight of the scales.

2. A scale tensioning device as claimed in claim 1 in which said head structure has a supporting plate thereon, and said rotating member is a cylindrical member having the outer peripheral portion thereof rotatably journaled in said supporting plate.

3. A scale tensioning device as claimed in claim 2 in which said rotating member has a feed screw extending diametrically thereacross, and said eccentric member comprises a knob threaded onto said feed screw and an element extending axially of said cylindrical member from said knob, said cylindrical member having an end plate on one end with a diametrically extending slot therein parallel to said feed screw, said element extending through said slot and being slidable therein and having the spring connected thereto outside said slot, said knob being rotatable relative to said element and said element being carried along with said knob as said knob is moved along said feed screw during rotation thereof.

* * * * *